US006196182B1

(12) United States Patent
Kawamura

(10) Patent No.: US 6,196,182 B1
(45) Date of Patent: Mar. 6, 2001

(54) ENGINE COVER STRUCTURE

(75) Inventor: Fumiaki Kawamura, Hamamatsu (JP)

(73) Assignee: Suzuki Motor Corporation (JP)

( * ) Notice: Subject to any disclaimer, the term of this patent is extended or adjusted under 35 U.S.C. 154(b) by 0 days.

(21) Appl. No.: 09/409,200

(22) Filed: Sep. 30, 1999

(30) Foreign Application Priority Data

Sep. 30, 1998 (JP) ..... 10-292905

(51) Int. Cl.[7] ..... F02F 7/00
(52) U.S. Cl. ..... 123/195 A; 123/195 C
(58) Field of Search ..... 123/195 C, 195 A, 123/192.1, 198 E

(56) References Cited

U.S. PATENT DOCUMENTS 4,508,072 * 4/1985 Takami et al. ..... 123/195 C
4,793,300 * 12/1988 Kadoshima et al. ..... 123/195 A
5,437,344 * 8/1995 Wada ..... 123/192.1

FOREIGN PATENT DOCUMENTS 6-25652 7/1994 (JP) .

* cited by examiner

*Primary Examiner*—Marguerite McMahon
(74) *Attorney, Agent, or Firm*—Morrison Law Firm

(57) ABSTRACT

A section of an engine mount bracket and a section of an engine accessory pass through a timing belt cover from the inside to the outside of the engine. The timing belt cover has an engine accessory opening and an engine mount bracket opening. During engine assembly, the engine accessory opening and engine mount bracket opening are aligned with the engine mount bracket and engine accessory, providing accurate alignment of the timing belt cover onto the engine. The alignment process prevents damage of the timing belt cover bolts as well as the threaded timing belt cover bolt insertion openings, resulting in an efficient process for engine assembly.

18 Claims, 14 Drawing Sheets

ENGINE COVER STRUCTURE

BACKGROUND OF THE INVENTION

The present invention relates to an engine cover structure. More specifically, the present invention relates to an engine mount and structure used to attach a timing belt cover.

In a conventional engine mount and timing belt cover, the timing belt cover includes an inside cover and an outside cover. The timing belt is enclosed by the cover when the inside and outside covers are joined. The inside cover is secured to the engine with bolts that fit into threaded openings in the engine block. The outside cover must then be visually aligned in relation to a plurality of openings around the perimeter of the inside cover. If the outside cover is not correctly aligned, the belt cover clamping bolts will not seat properly. An improper alignment leads to misalignment problems including damaging or stripping the threaded opening designed to receive the belt cover clamping bolts. In order to prevent this kind of damage, the outside cover must often be realigned, making assembly more time consuming, thereby decreasing efficiency.

If a separate part is provided to allow the timing belt cover to be aligned, the number of parts is increased, the structure becomes more complex, and costs are increased.

Referring to FIGS. 20 through 22, a conventional engine mount and timing belt cover 202 includes a cylinder block 204 with a cylinder head 206 mounted thereon. A crank shaft 208 is on cylinder block 204. A crank timing pulley 210 is fixed to crank shaft 208 using a crank pulley attachment bolt 212. A cam shaft 214 is disposed on cylinder head 206. A cam timing pulley 216 is fixed to cam shaft 214 using a cam pulley attachment bolt 218. A timing belt 220, wrapped around crank pulley 210 and cam pulley 216, is driven by crank shaft 208.

Other engine components can be operated by timing belt 220. A water pump 222 is an engine component that is operated by timing belt 220. A water pump housing 224 attaches to cylinder block 204 with a plurality of water pump clamping bolts 226. A belt tensioner 228 attaches to cylinder block 204 with a tensioner attachment bolt 230. An oil pump 232 is another engine component operated by timing belt 220.

A timing belt inside cover 234 attaches to cylinder head 206, water pump 222, oil pump 232, cylinder block 204, and cylinder head 206 using a plurality of inside cover clamping bolts (not shown in the figures).

A timing belt outside cover 238 attaches to timing belt inside cover 234, water pump 222, and oil pump 232 using a plurality of belt cover clamping bolts 240 disposed along the perimeter of timing belt cover 238. Timing belt cover 238 forms a belt chamber 236 for timing belt 220.

When timing belt cover 238 is attached, a plurality of belt cover bolt insertion openings (not shown in the figures), formed on timing belt cover 238, are aligned with a plurality of belt cover bolt openings 242 formed on timing belt inside cover 234. Belt cover clamping bolts 240 are then screwed in to attach timing belt cover 238.

This type of timing belt cover structure has been presented in Japanese laid-open utility model publication number 6-25652, Japanese utility model number 2545119, Japanese laid-open utility model publication number 5-79195, Japanese laid-open utility model publication number 63-146256, Japanese laid-open utility model publication number 63-9444, Japanese laid-open patent publication number 7-259578, Japanese laid-open patent publication number 6-193460, Japanese laid-open patent publication number 5-203019, Japanese laid-open utility model publication number 5-89845, and Japanese laid-open utility model publication number 3-43563.

In the conventional technology disclosed in Japanese examined utility model publication number 6-25652, a pump case of a water pump and an engine mount bracket are disposed adjacent to each other. A ring-shaped rib is disposed on the outer surface of the water pump case to provide improved sealing.

Japanese utility model publication number 2545119 discloses a timing belt cover divided into a plurality of sections.

Japanese laid-open utility model publication number 5-79195 discloses a timing belt cover attached to a pump case with an elastic member interposed therebetween.

Japanese laid-open utility model publication number 63-146256 discloses a timing belt cover divided into sections, and an engine mount bracket disposed on the timing belt cover.

Japanese laid-open utility model publication number 63-9444 discloses an engine mounting bracket seat on an end cover.

Japanese laid-open patent publication number 7-259578 discloses an engine mount attachment seat on a timing belt cover.

Japanese laid-open patent publication number 6-193460 discloses a side of a chain cover toward an engine cylinder block attached to the lower portion of an engine mount bracket.

Japanese laid-open patent publication number 5-203019 discloses an engine mount bracket disposed on a front cover.

Japanese laid-open utility model publication number 5-89845 discloses a longitudinal section of a timing belt cover formed as a high-strength section. An attachment section for the main engine unit is disposed on this high-strength section.

Japanese laid-open utility model publication number 3-43563 discloses an engine mounting structure having radial ribs to connect thick sections of a cam journal, boss, and the like.

OBJECT AND SUMMARY OF THE INVENTION

It is an object of the present invention to provide an engine mount and cover structure which overcomes the foregoing problems.

It is a further object of the present invention to provide an engine mount and cover structure having components which allow for efficient assembly.

It is another object of the present invention to provide an engine structure allowing accurate alignment of a timing belt cover onto an engine.

The present invention provides an engine cover structure in which an engine accessory is fixed to a cylinder block of an engine. A crank shaft is disposed on the cylinder block. A crank timing pulley is fixed to the crank shaft. A cam shaft is disposed on a cylinder head of the engine. A timing pulley is fixed to the cam shaft. A timing belt extends between the crank timing pulley and the cam timing pulley. A timing belt cover is fixed to the engine using belt cover clamping bolts so that the timing belt cover surrounds the timing belt. In this engine cover structure, an engine mount bracket is fixed to the cylinder block. A section of the engine mount bracket and a section of the engine accessory are passed through the timing belt cover from the inside to the outside.

Briefly stated, the present invention provides a section of an engine mount bracket and a section of an engine accessory passing through a timing belt cover from the inside to the outside of the engine. The timing belt cover has an engine accessory opening and an engine mount bracket opening. During engine assembly, the engine accessory opening and engine mount bracket opening are aligned with the engine mount bracket and engine accessory, providing accurate alignment of the timing belt cover onto the engine. The alignment process prevents damage of the timing belt cover bolts as well as the threaded timing belt cover bolt insertion openings, resulting in an efficient process for engine assembly.

According to an embodiment of the present invention, there is provided a structure for an engine comprising an engine mount bracket attached to the engine; an engine accessory attached to the engine; a timing belt cover attached to the engine; the timing belt cover having at least a accessory insertion opening and a bracket insertion opening; and a section of the engine mount bracket passing through the bracket insertion opening and a section of the engine accessory passing through the accessory insertion opening, thereby accurately aligning the timing belt cover on the engine.

According to another embodiment of the present invention, there is provided an engine structure comprising an engine accessory attached to a cylinder block of the engine; a crank timing pulley on a crank shaft of the engine; a cam shaft on a cylinder head of the engine; a timing pulley on the cam shaft; a timing belt extending between the crank timing pulley and the cam timing pulley; a timing belt cover fixed to the engine; an engine mount bracket on the cylinder block; and a section of the engine mount bracket and a section of the engine accessory passing through the timing belt cover, thereby accurately aligning the timing belt cover with the engine.

The above, and other objects, features and advantages of the present invention will become apparent from the following description read in conjunction with the accompanying drawings, in which like reference numerals designate the same elements.

DETAILED DESCRIPTION OF THE PREFERRED EMBODIMENTS

Figure 1:
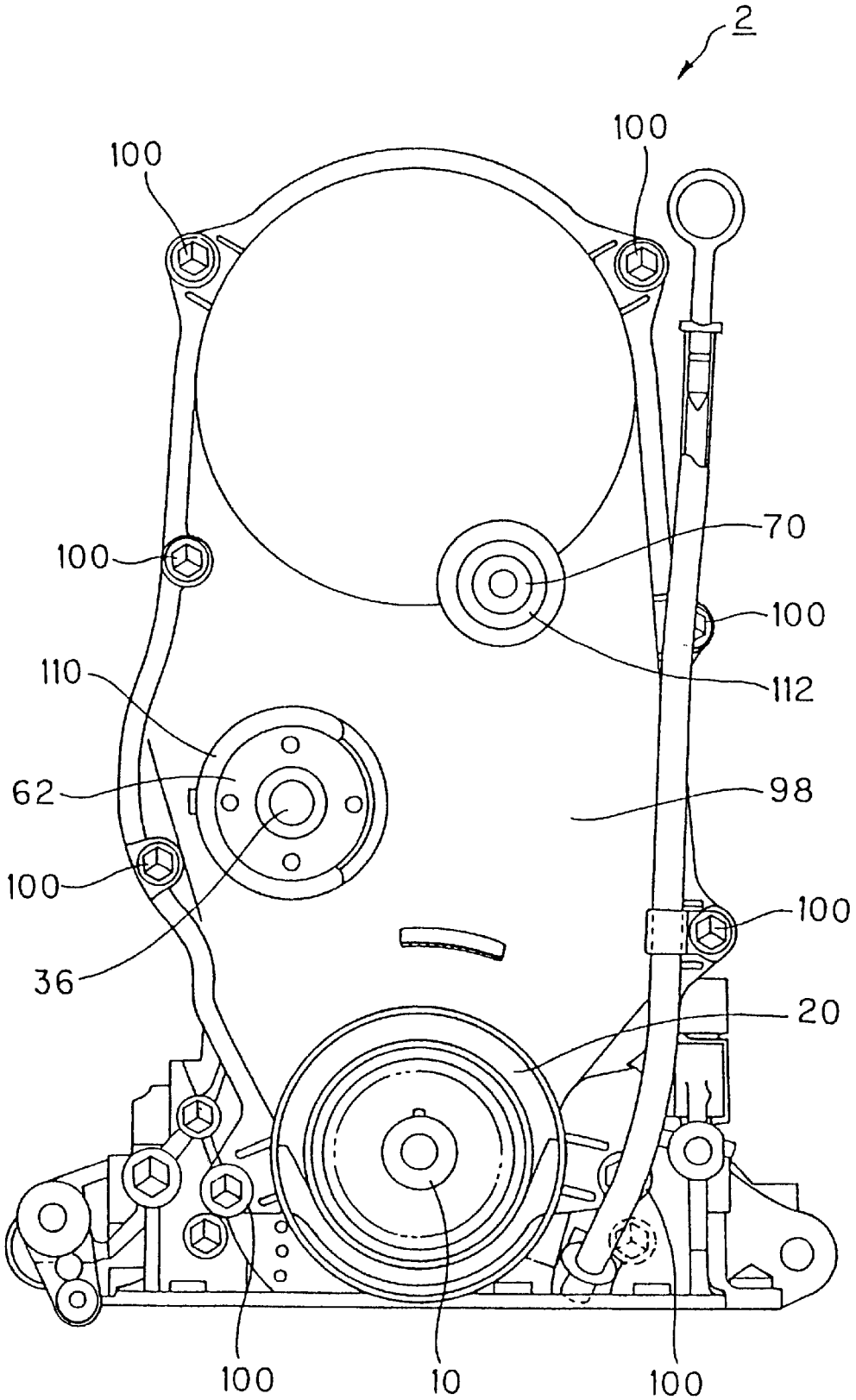
FIG. 1 is a front-view drawing of an engine.
Figure 2:
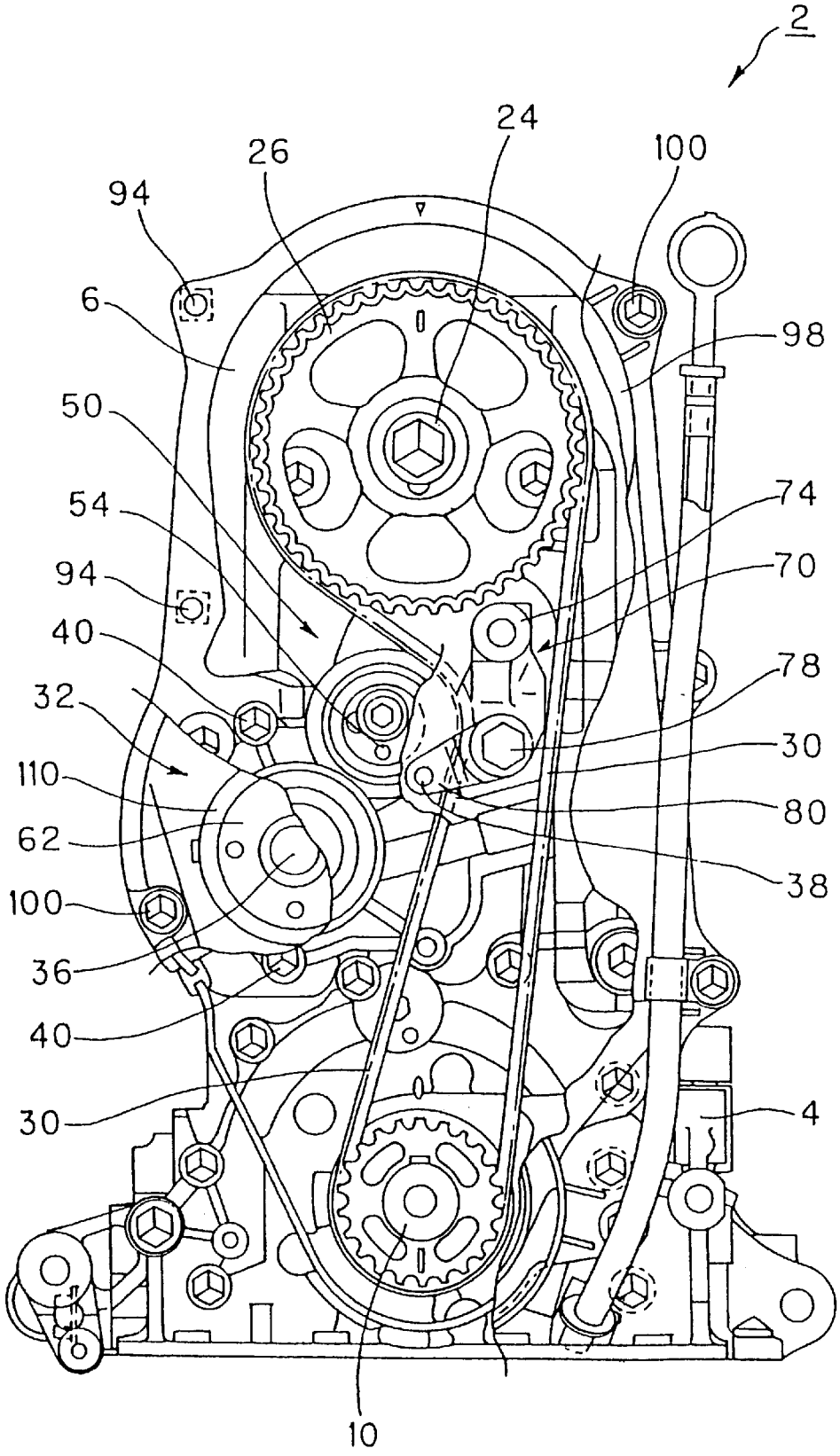
FIG. 2 is a partially cut-away cross-sectional drawing of the engine of FIG. 1.

Referring to FIGS. 1 through 4, an engine 2, mounted in an automobile (not shown in the figures), includes a cylinder block 4, a cylinder head 6, and a cylinder head cover 8.

A crank shaft 10 is supported in cylinder block 4. A trochoidal oil pump 12, driven by the end surface of crank shaft 10, is an engine accessory. Oil pump 12 has an oil pump case 14 and an integrally formed pump plate 16. A knock pin (not shown in the figures) and an oil pump clamping bolt (not shown in the figures) provide accurate positioning of oil pump case 14 to stud bolt threaded openings 4*a* on the end surface of cylinder block 4.

A crank timing pulley 18 and a crank pulley 20 are attached to an end of crank shaft 10 with a crank pulley attachment bolt 22. A cam shaft 24 is supported in cylinder head 6. A cam timing pulley 26 attaches to cam shaft 24 with a cam pulley attachment bolt 28. A timing belt 30 extends across crank timing pulley 18 and cam timing pulley 26.

A water pump 32 is on cylinder block 4 as an engine accessory. Water pump 32 includes a water pump case 34 and a water pump shaft 36.

Referring to FIGS. 3 and 4 and FIGS. 7 through 9, one end of water pump case 34 is positioned with stud bolts 38 fixed in stud bolt threaded openings 4*a* on one end surface of cylinder block 4. Stud bolts 38 and another water pump attachment bolt 40 serve to attach water pump case 34 to the end surface of cylinder block 4. End sections 38*a* of stud bolts 38 engage with nuts 42. A diameter D1 of a stud bolt insertion opening 44, through which stud bolts 38 of water pump case 34 are inserted, matches the maximum diameter of stud bolts 38. Diameter D1 is slightly smaller than a diameter D2 of a water pump bolt insertion opening 46, through which a water pump clamping bolt 40 is inserted. These relative diameters allows for the attachment of water pump case 34 to cylinder block 4 with accurate alignment. A belt tensioner attachment seat 48 is on water pump case 34. A belt tensioner 50 attaches to belt tensioner attachment seat 48 to adjust the tension of timing belt 30. Belt tensioner 50 rotates around a rotation shaft 54 disposed in a shaft opening 52 formed on belt tensioner attachment seat 48.

A water pump shaft 36 extends in the same direction as crank shaft 10. A pump impeller 56 is disposed on the end of water pump shaft 36 having a smaller diameter. Pump impeller 56 circulates cooling water inside a water jacket 58 of cylinder block 4. One end of water pump shaft 36 is supported at one end of water pump case 34 by a shaft sealing member 60. The end of water pump shaft 34 with the larger diameter is supported at the other end of water pump case 34. An attachment flange 62 is fixed to a section of water pump shaft 34 projecting out from the end surface of water pump case 34. A water pump pulley 64 attaches to attachment flange 62 using a pump-pulley attachment bolt 66. Water pump pulley 64 and crank pulley 20 are attached after a timing belt cover 98, described later, is attached to engine 2. A drive belt 68 extends between water pump pulley 64 and crank pulley 20.

Figure 5:
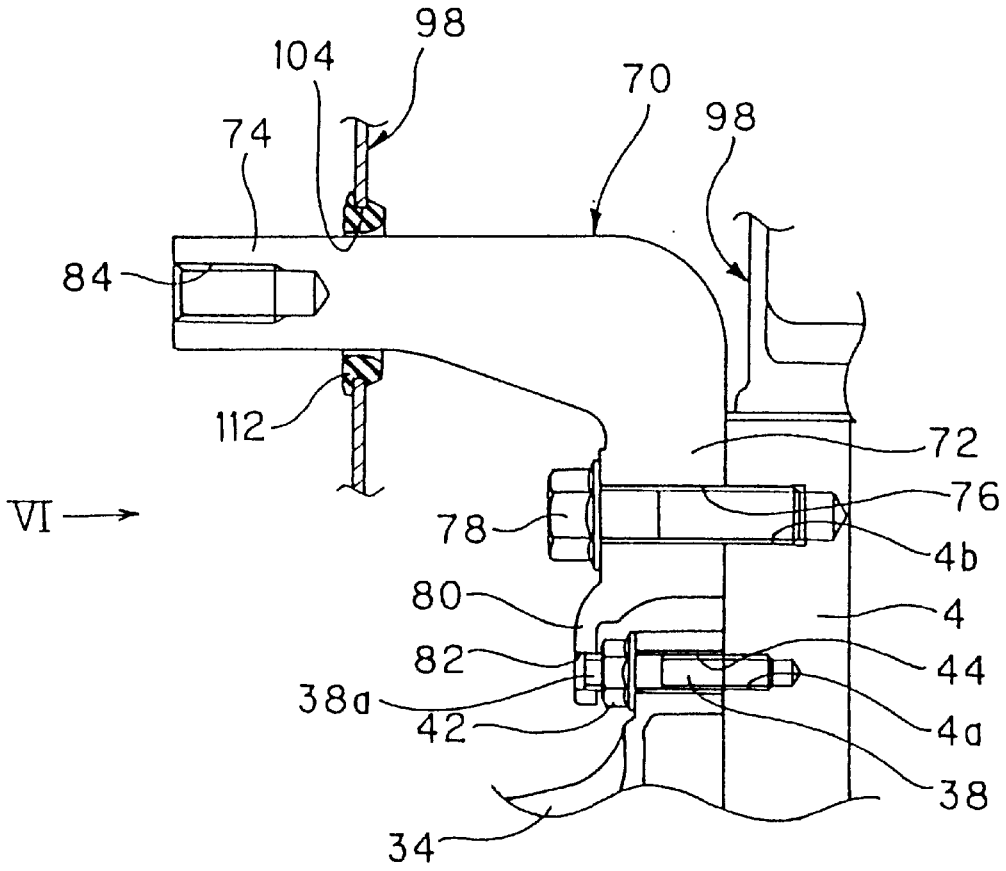
FIG. 5 is a side-view drawing of the attachment section of the engine mount bracket.
Figure 6:
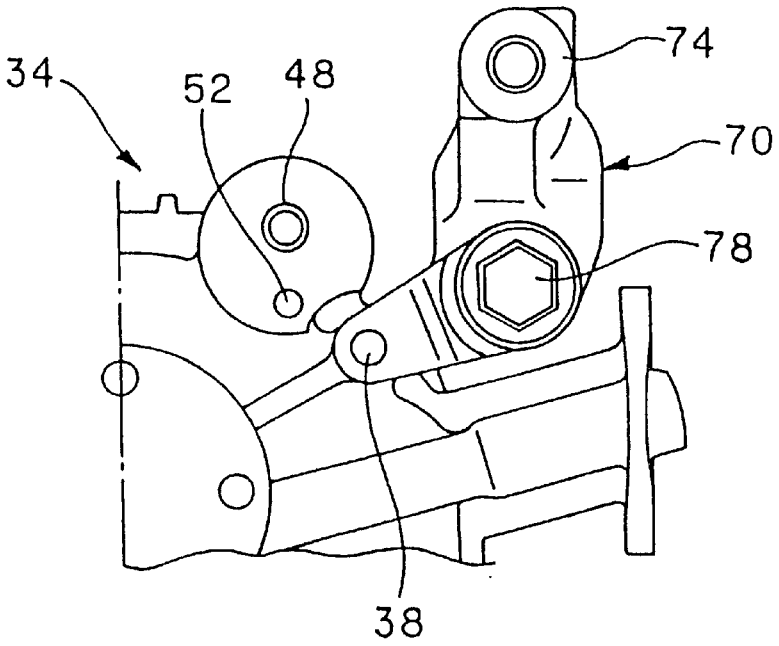
FIG. 6 is a side-view drawing as seen from arrow IV from FIG. 5.
Figure 7:
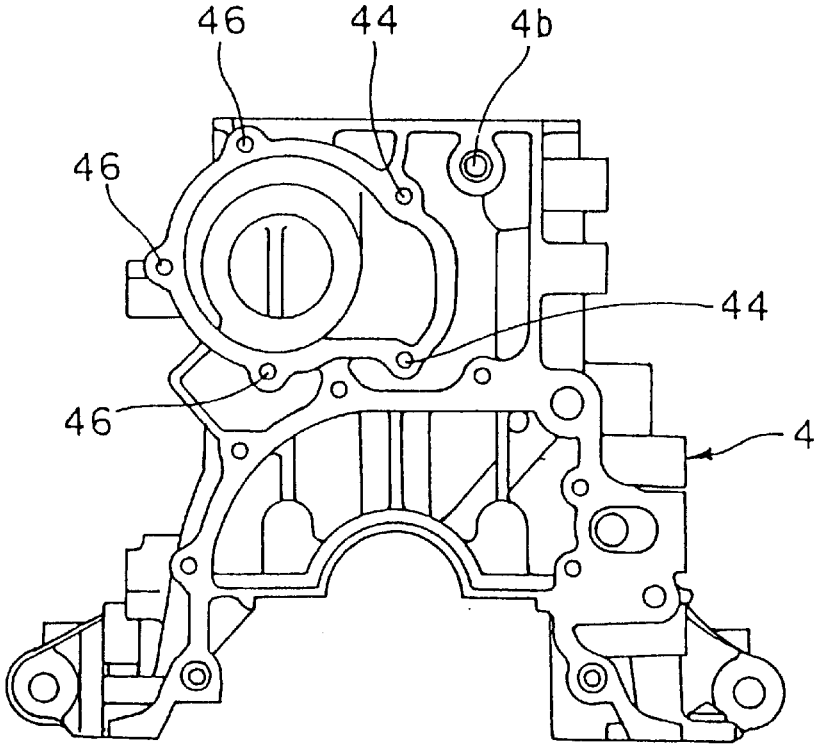
FIG. 7 is a front-view drawing of the cylinder block.
Figure 8:
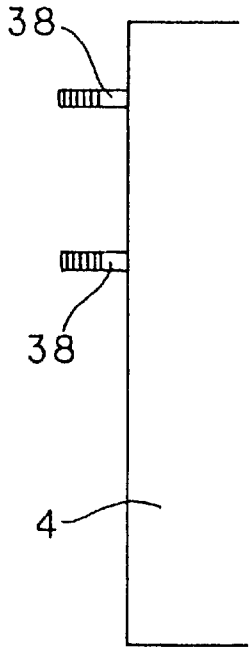
FIG. 8 is a schematic side-view drawing of FIG. 7.
Figure 9:
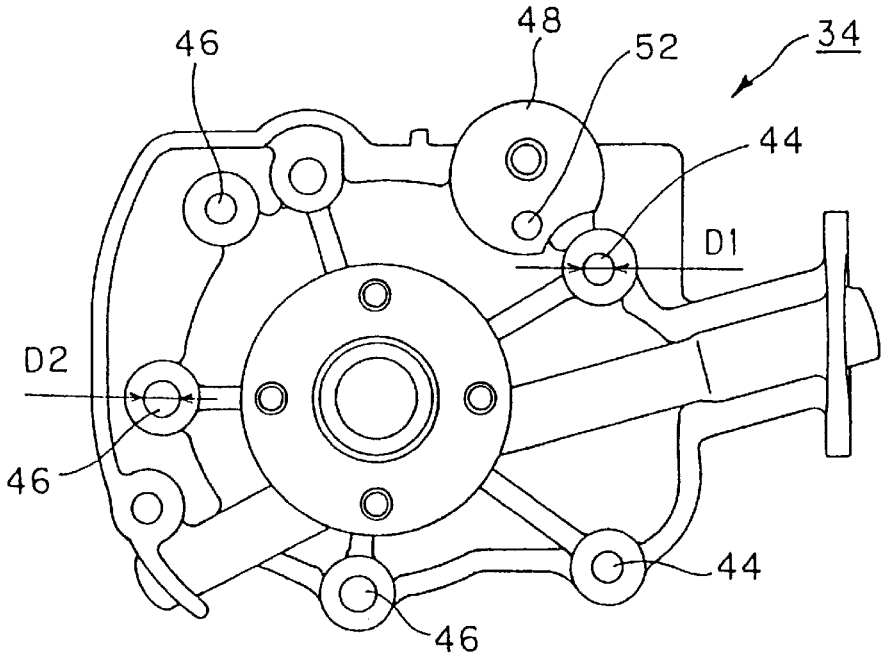
FIG. 9 is a front-view drawing of the water pump case.

Referring to FIG. 5 and FIG. 6, an engine mount bracket 70 attaches to an end surface of cylinder block 4. Engine mount bracket 70 includes a fixing side 72, located toward cylinder block 4, and a mount attachment boss 74, connected to fixing side 72, extending parallel to water pump shaft 36. Fixing side 72 is fixed using a bracket clamping bolt 78 inserted through a bracket bolt insertion opening 76 into a bracket bolt threaded opening 4*b* formed on the end surface of cylinder block 4. To allow engine mount bracket 70 to be properly aligned, an alignment extension 80 is formed as a projection on fixed side 72 toward water pump case 34 and stud bolt 38. Alignment extension 80 has an alignment opening 82 into which an end section 38*a* of stud bolt 38, projecting from a nut 42 engaged with end section 38*a* of stud bolt 38, is inserted. When attaching fixing side 72 of engine mount bracket 70 to cylinder block 4 using bracket clamping bolt 78, alignment opening 82 is fitted to end section 38*a* of stud bolt 38. This allows engine mount bracket 70 to be properly aligned and accurately positioned at a prescribed position. Even if nut 42 becomes loose, alignment extension 80 prevents nut 42 from dropping. Also, a mount attachment threaded opening 84 is formed on an end surface of mount attachment boss 74 of engine mount bracket 70.

Figure 10:
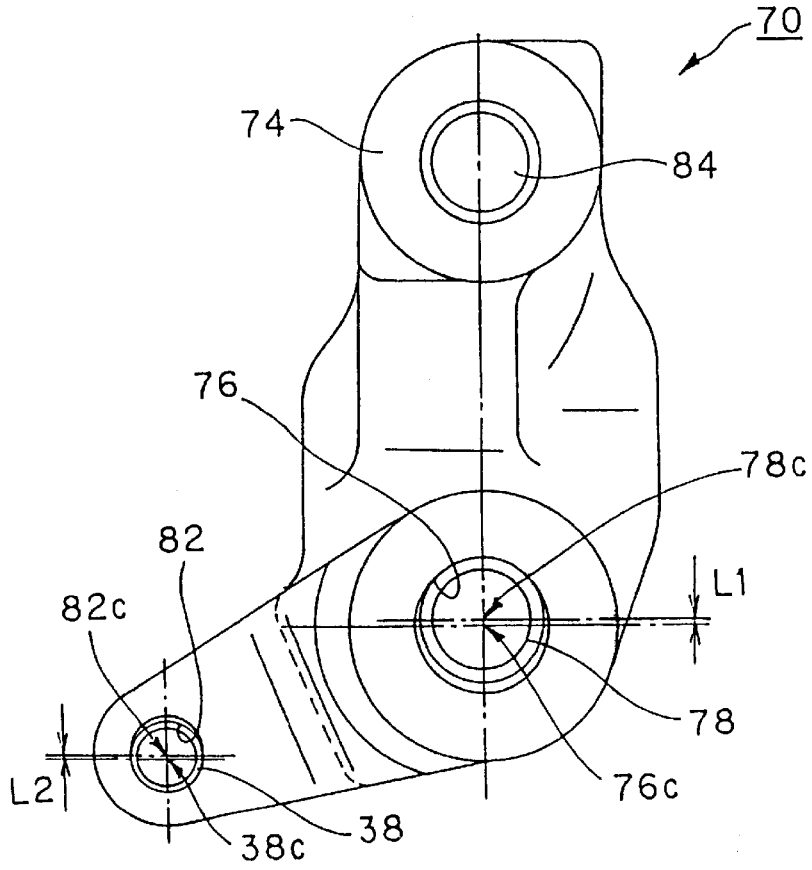
FIG. 10 is a front-view drawing of the engine mount bracket.

Referring to FIG. 10, in this embodiment of engine mount bracket 70, a center 78*c* of bracket attachment bolt 78 is offset by a distance L1 from a center 76*c* of bracket bolt insertion opening 76 of bracket attachment bolt 78. A center 82*c* of alignment opening 82 is offset from a center 38*c* of stud bolt 38 by a distance L2.

Figure 3:
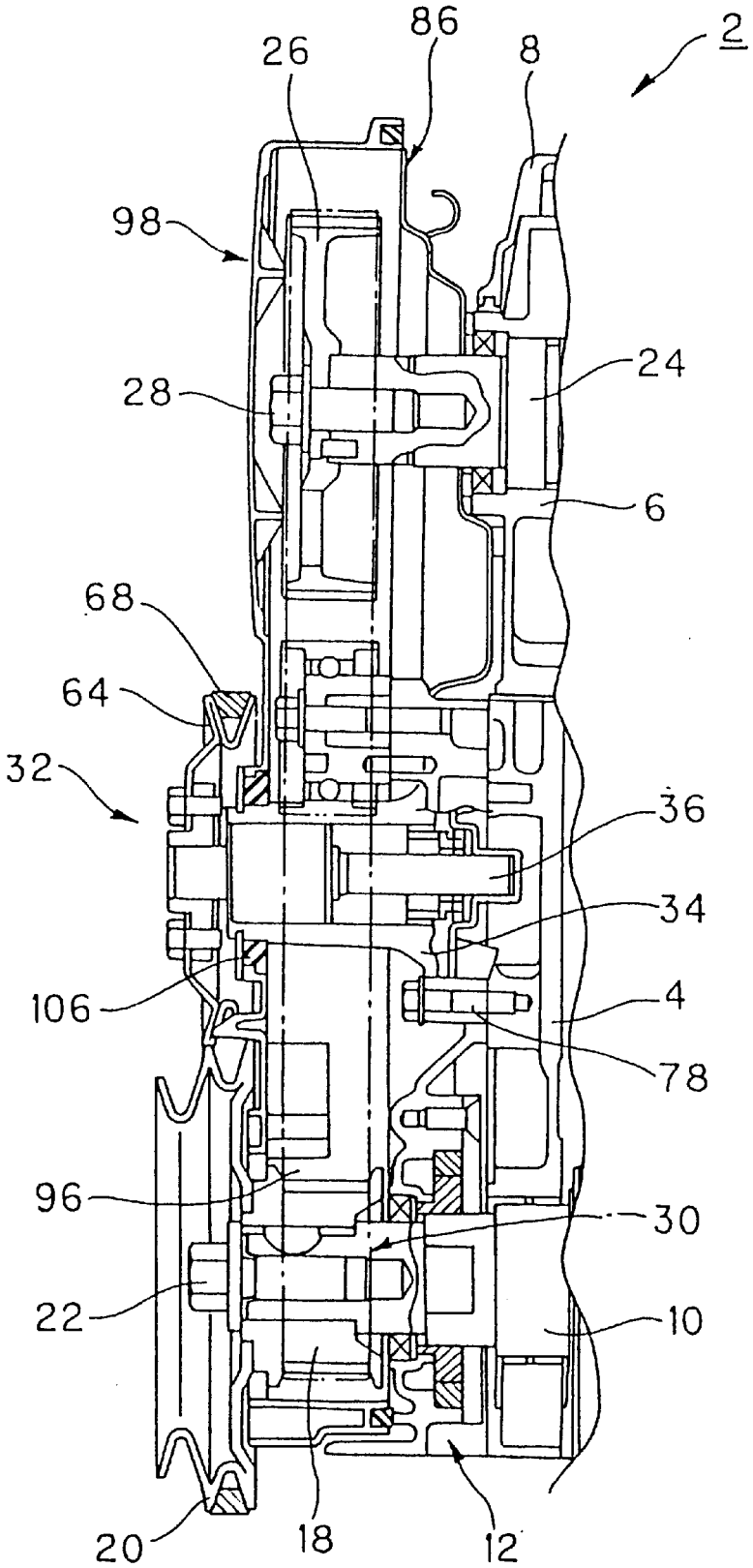
FIG. 3 is a cross-section drawing of the engine of FIG. 1.
Figure 4:
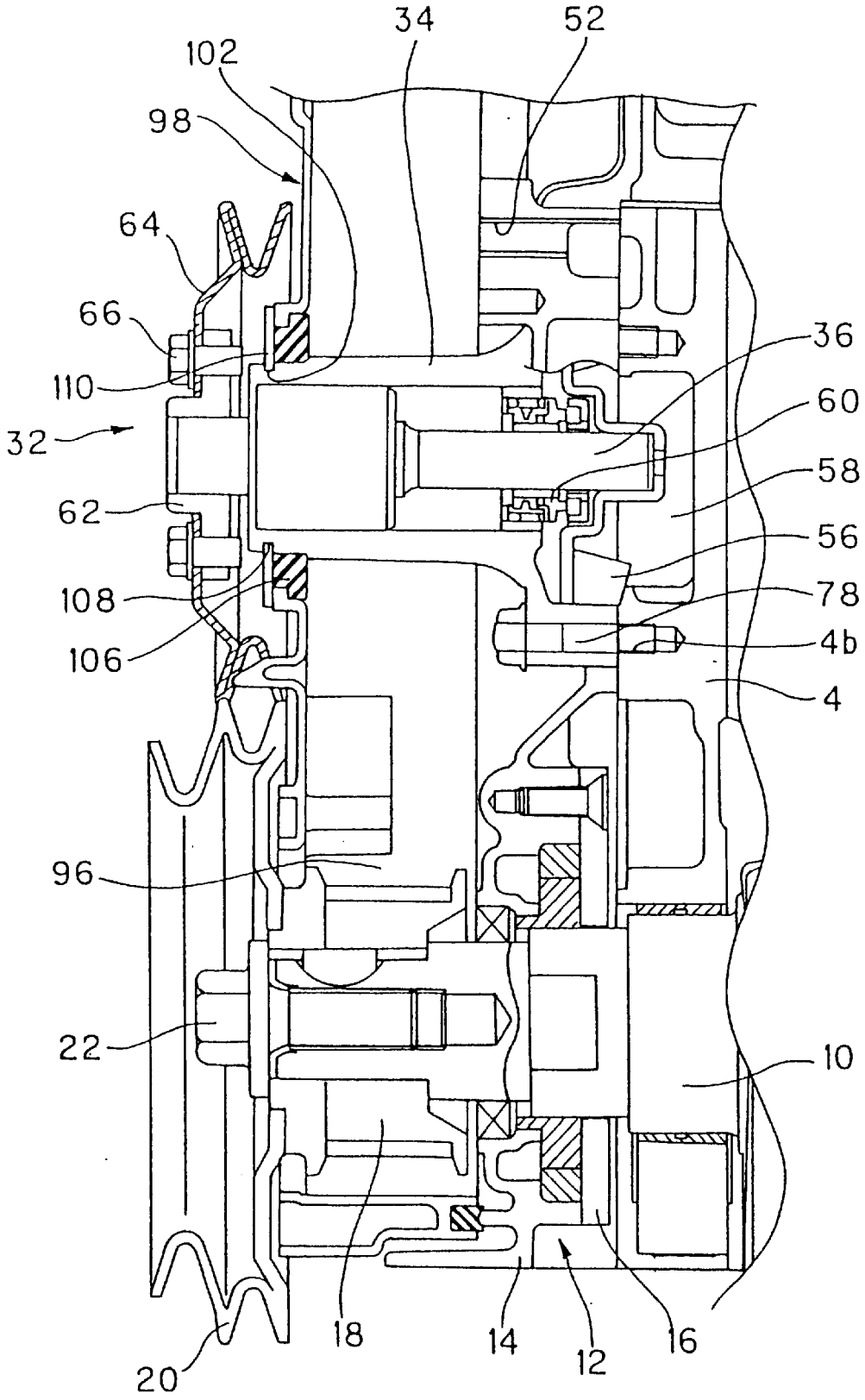
FIG. 4 is a schematic close-up drawing of FIG. 3.
Figure 11:
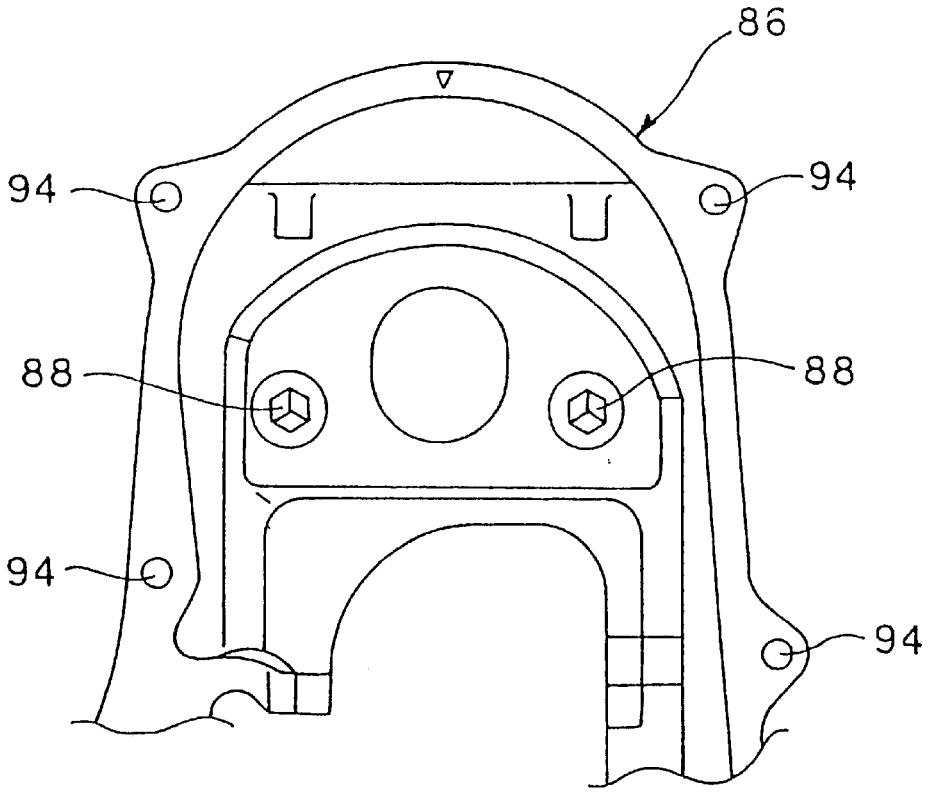
FIG. 11 is a front-view drawing showing the timing belt inside cover in an attached state.
Figure 12:
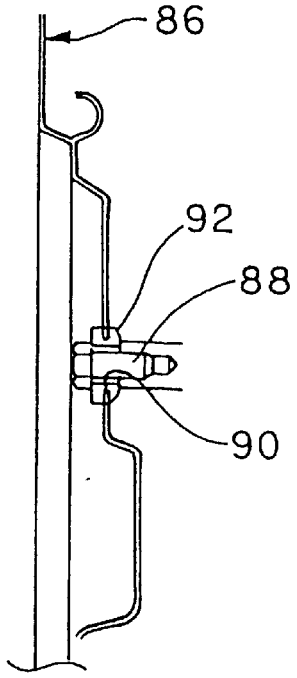
FIG. 12 is a side-view drawing of FIG. 11.

Referring to FIG. 3, FIG. 11, and FIG. 12, a timing belt inside cover 86 attaches to an end surfaces of cylinder block 4 and cylinder head 6 using inside cover clamping bolts 88. Inside cover clamping bolts 88 are inserted through a grommet 92 into an inside cover bolt insertion opening 90 of timing belt inside cover 86. Inside cover clamping bolts 88 screw to cylinder head 6. A plurality of belt cover bolt threaded openings 94 are along a perimeter of timing belt inside cover 86.

A timing belt cover 98 attaches with belt cover clamping bolts 100 to timing belt inside cover 86, water pump case 34, and oil pump case 14 to form a belt chamber 96 along timing belt 30. A plurality of cover bolt insertion openings (not shown in the figures) are along a perimeter of timing belt cover 98.

Timing belt cover 98 has a pump-side insertion opening 102 and a bracket-side insertion opening 104. An end of water pump case 34 passes through pump-side insertion opening 102. Mount attachment boss 74, which is a section of engine mount bracket 70, passes through bracket-side insertion opening 104.

Referring again to FIG. 4, the other end of water pump case 34 is supported on the side of timing belt cover 98 toward water pump case 34 with a pump-side sealing member 106. Pump-side sealing member, which is an accessory-side sealing member, is supported with an E-ring 110 attached to an E-ring groove 108 of water pump case 34. Pump-side sealing member seals pump-side insertion opening 102.

Referring back to FIG. 5, in engine mount bracket 70, mount attachment boss 74 is supported by a bracket-side sealing member 112.

First Embodiment

Stud bolt 38 is inserted through stud bolt insertion opening 44, having a diameter that corresponds to the maximum diameter of stud bolt 38. Diameter D1, of stud bolt insertion opening 44, is smaller than diameter D1, of water pump bolt insertion opening 46. This attaches pump case 34 to cylinder block 4 and cylinder head 6, while allowing water pump 32 to be accurately aligned to cylinder block 4.

With engine mount bracket 70, end section 38*a* of stud bolt 38 is fitted in bracket attachment bolt 78 and alignment opening 82. Center 76*c*, of bracket bolt insertion opening 76, is offset from center 78*c*, of bracket attachment bolt 78, by a distance L1. Center 82*c*, of positioning opening 82, is offset from center 38*c*, of stud bolt 38, by a distance L2. This allows for the attachment of engine mount bracket 70 to cylinder block 4 with an accurate alignment.

With oil pump 12, the knock pin and the oil pump clamping bolt (not shown in the figures) are used to accurately align oil pump 12 to the end surface of cylinder block 4.

Thus, water pump 32, engine mount bracket 70, and oil pump 12 are attached to cylinder block 4 with accurate alignment relative to each other.

Timing belt cover 98 is guided into place by pump-side sealing member 106 on one side of water pump case 34 of water pump 32. Timing belt cover 98 is also guided by bracket-side sealing member 112 of mount attachment boss 74 of engine mount bracket 70. This allows timing belt cover 98 to be accurately aligned with water pump 32 and oil pump 12. As a result, the cover bolt insertion openings of timing belt cover 98 are aligned with belt cover bolt threaded openings 94 on water pump 32 and oil pump 12. This allows timing belt cover 98 to be attached quickly and easily while preventing belt cover bolt threaded openings 94 from being damaged.

Inside cover attachment bolt 88 attaches timing belt inside cover 86 to cylinder head 6 through grommet 92. Thus, when timing belt cover 98 is being attached, belt cover bolt threaded opening 94 is easily aligned to the belt cover bolt opening on timing belt cover 98, thereby avoiding attachment difficulties.

Since timing belt cover 98 is attached while being guided by a section of water pump case 32 and a section of engine mount bracket 70, timing belt cover 98 is accurately aligned, and attachment is easily performed. Separate parts are unnecessary, making the structure simple and inexpensive.

Since pump-side sealing member 106 is on pump-side opening 102, and bracket-side sealing member 112 is on bracket-side opening 104, timing belt cover 98 attaches firmly with no looseness. Furthermore, timing belt cover 98 is accurately aligned.

With water pump case 34 of water pump 32, stud bolt 38 is inserted through positioning opening 82, having diameter D2 that is smaller than diameter D1 of water pump bolt insertion opening 44. Thus, stud bolt 38 provides alignment without the need for separate parts. This allows water pump 32 to be aligned accurately and inexpensively.

Furthermore, center 76*c*, of bracket bolt insertion opening 76, and center 78*c*, of bracket clamping bolt 78, are offset by distance L1. Center 82*c*, of alignment opening 82, and center 38*c*, of stud bolt 38, are offset by distance L2. This allows engine mount bracket 70 to be positioned accurately without the use of separate parts, while only requiring a simple and inexpensive structure.

In engine mount bracket 70, alignment is performed with end section 38*a* of stud bolt 38. Thus, separate parts such as knock pins are not required, reducing the number of parts. Moreover, there is no need to form an opening on cylinder block 4, thus further reducing costs.

Since alignment extension 80 of engine mount bracket 70 is positioned at end section 38*a* of stud bolt 38, nut 42 cannot come off even if it becomes loose. This prevents nut 42 from damaging other parts.

Since engine mount bracket 70 is not fixed to separate elements, such as water pump 32, the vibrations from the engine mount attached to mount attachment boss 74 does not affect the other elements, such as a water pump gasket (not shown in the figures). Thus, leakage and the like are prevented.

Second Embodiment

Figure 13:
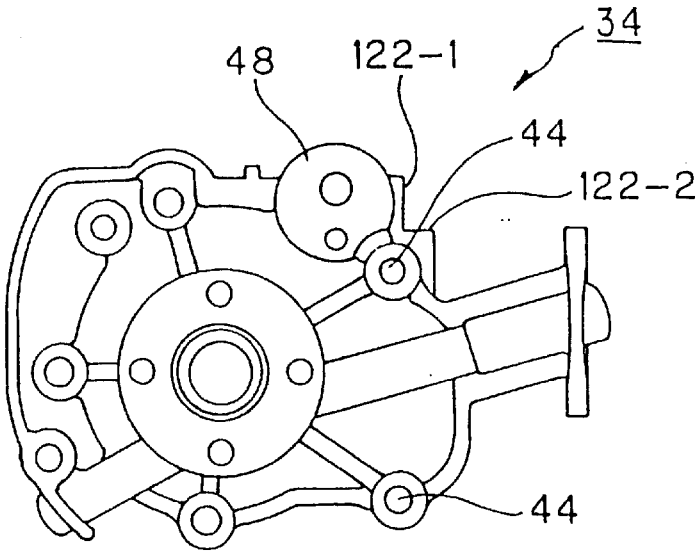
FIG. 13 is a front-view drawing of the water pump case according to a second embodiment.
Figure 14:
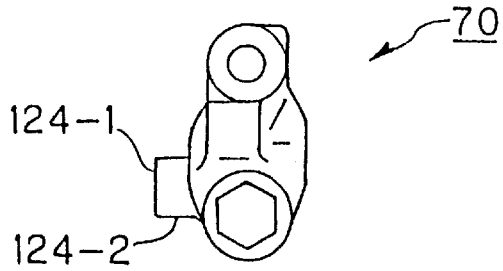
FIG. 14 is a front-view drawing of the engine mount bracket according to the second embodiment.
Figure 15:
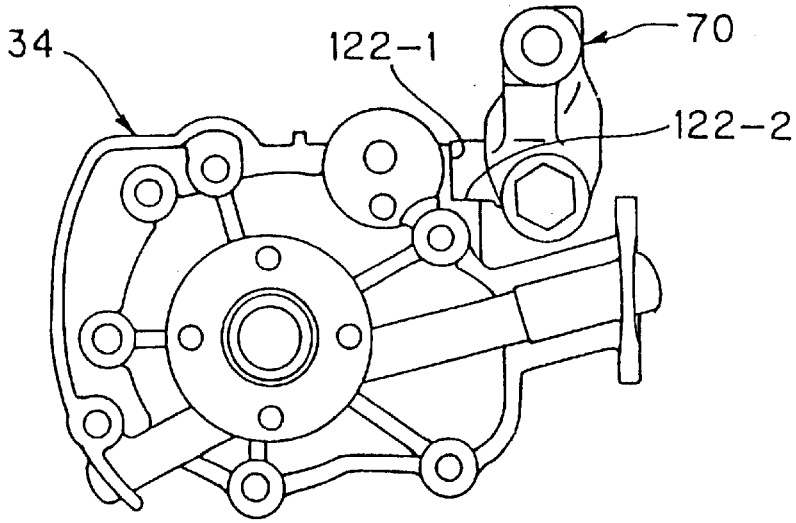
FIG. 15 is a front-view drawing showing the engine mount bracket attached to the water pump case according to the second embodiment.

Referring to FIGS. 13 through 15, a second embodiment of the present invention is described. Elements that serve the same function as the embodiment described above are assigned the same numerals.

The characteristics of the second embodiment of the present invention are as follows. Pump-side processed surfaces 122-1 and 122-2 are formed on sections of water pump case 34. Bracket-side processed surfaces 124-1 and 124-2, corresponding to pump-side processed surfaces 122-1 and 122-2, are on sections of engine mount bracket 70.

According to this second embodiment, bracket-side processed surfaces 124-1 and 124-2 engage with pump-side processed surfaces 122-1 and 122-2 so that water pump 32 and engine mount bracket 70 are accurately positioned.

Third Embodiment

Figure 16:
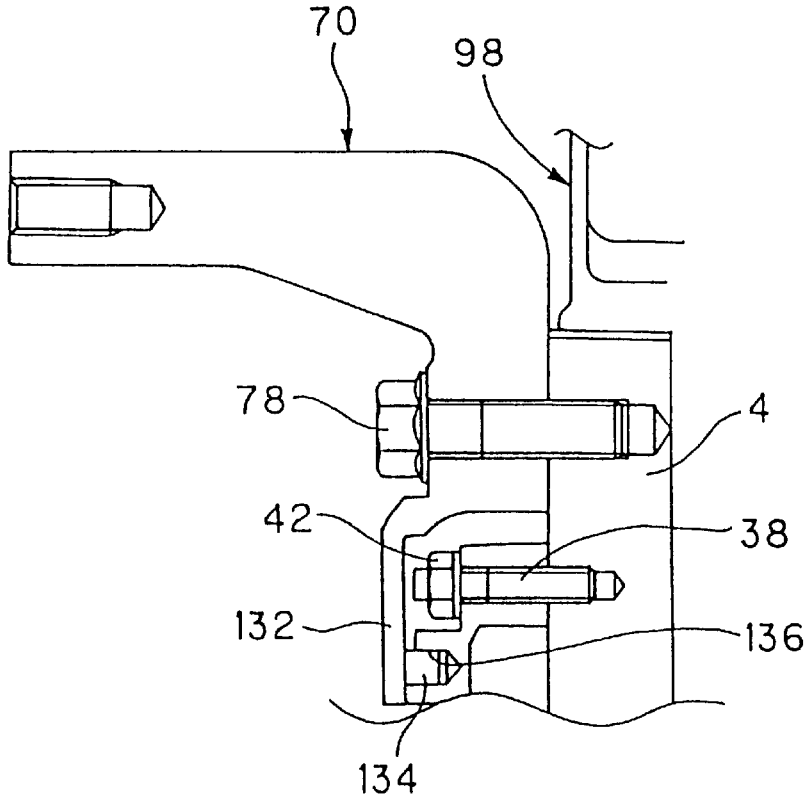
FIG. 16 is a side-view drawing showing the engine mount bracket, according to a third embodiment, in an attached state.
Figure 17:
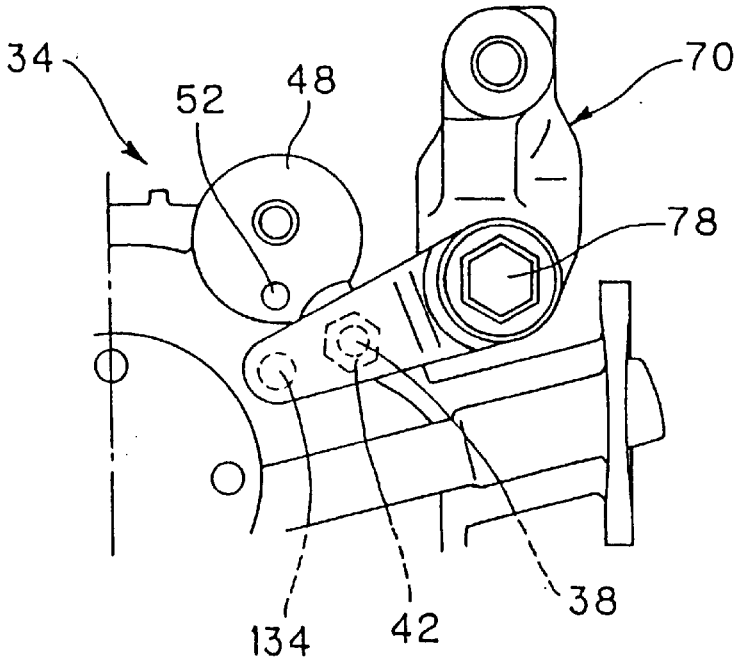
FIG. 17 is a side-view drawing of FIG. 16.

Referring to FIG. 16 and FIG. 17, a third embodiment of the present invention is described. The characteristics of the third embodiment are as follows. A positioning section 132 is on fixed-side section 74 of engine mount bracket 70. Positioning section 132 extends near end section 38*a* of stud bolt 38, covering nut 42. Positioning section projects toward water pump case 34. A positioning pin 134, oriented toward the surface of water pump case 34, is on positioning section 132. On the surface of water pump case 34, a positioning opening 136 faces positioning pin 134.

According to the third embodiment, when engine mount bracket 70 is attached, positioning pin 134 is inserted into positioning opening 136, thus allowing engine mount bracket 70 to be properly aligned. Since engine mount bracket 70 is then attached to cylinder block 4 using bracket clamping bolt 78, engine mount bracket 70 is accurately positioned.

Even if nut 42 comes loose, positioning section 132 prevents nut 42 from dropping down. This prevents nut 42 from damaging other elements.

Fourth Embodiment

Figure 18:
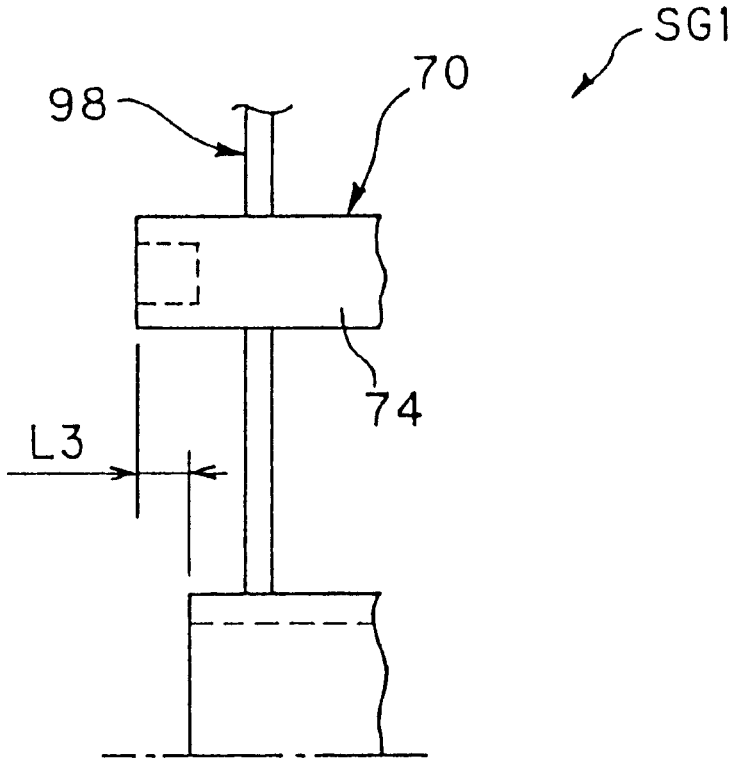
FIG. 18 is a drawing showing the positioning of the engine mount bracket and the water pump case according to a fourth embodiment.

Referring to FIGS. 5 and 18, a fourth embodiment SG1 of the present invention is described. The characteristics of fourth embodiment SG1 are as follows. Mount attachment boss 74 of engine mount bracket 70 projects from water pump case 34 by a distance L3. A staircase shape is formed from the projections of water pump case 34 and engine mount bracket 70.

According to this fourth embodiment, when timing belt cover 98 is attached, bracket-side opening 104 is fitted before pump-side opening 102, thus providing easier assembly.

Fifth Embodiment

Figure 19:
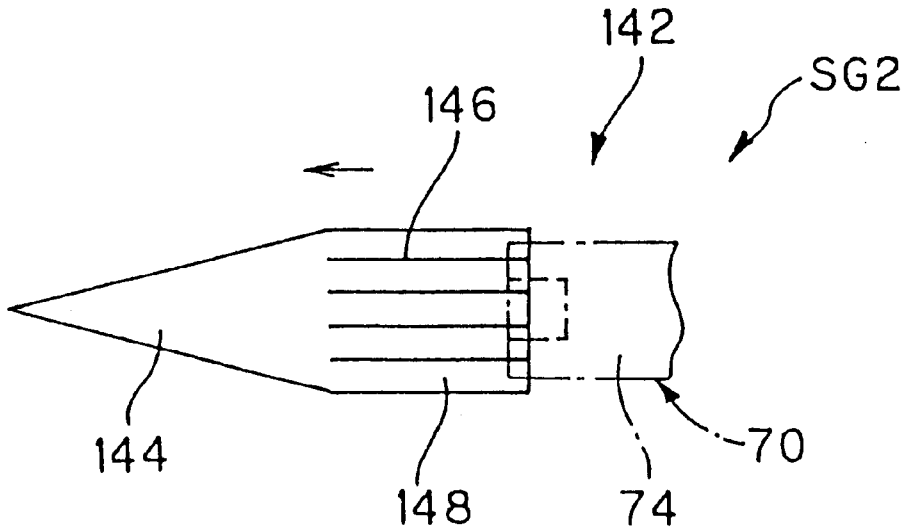
FIG. 19 is a side-view drawing of the guide body according to a fifth embodiment.
Figure 20:
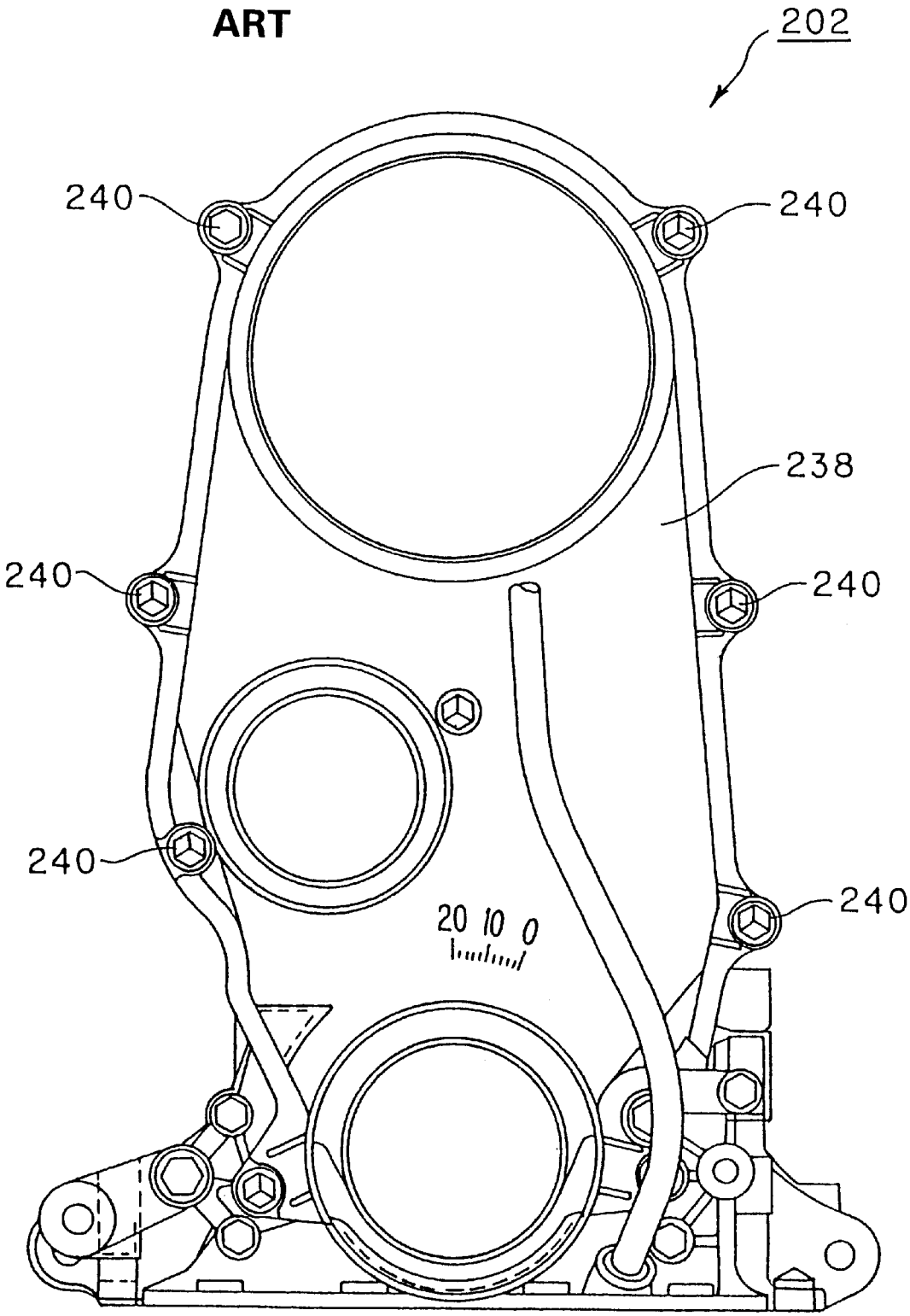
Fig. 20 PRIOR ART
FIG. 20 is a front-view drawing of a conventional engine.
Figure 21:
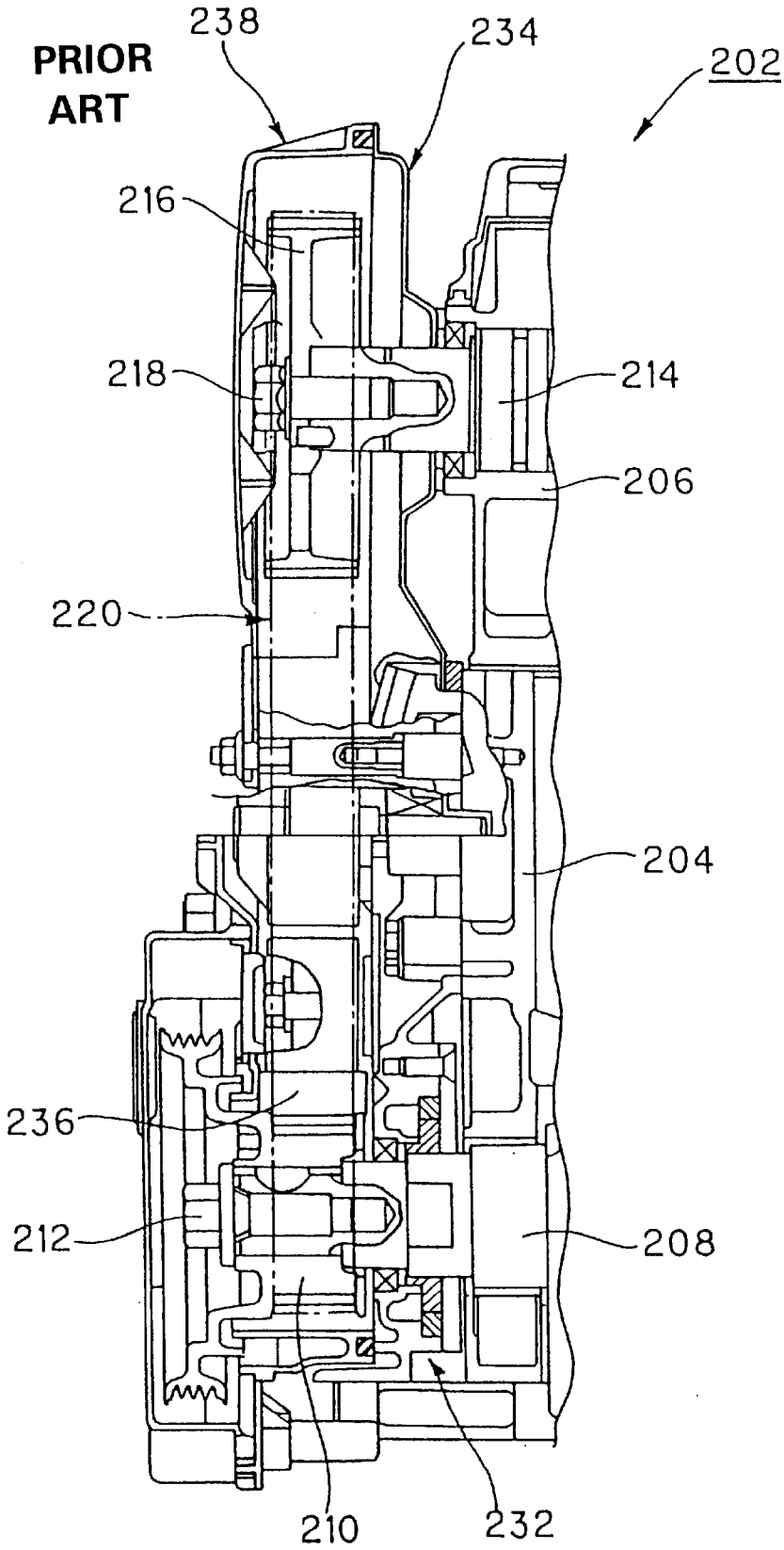
FIG. 21 is a cross-section drawing of a conventional engine.
Figure 22:
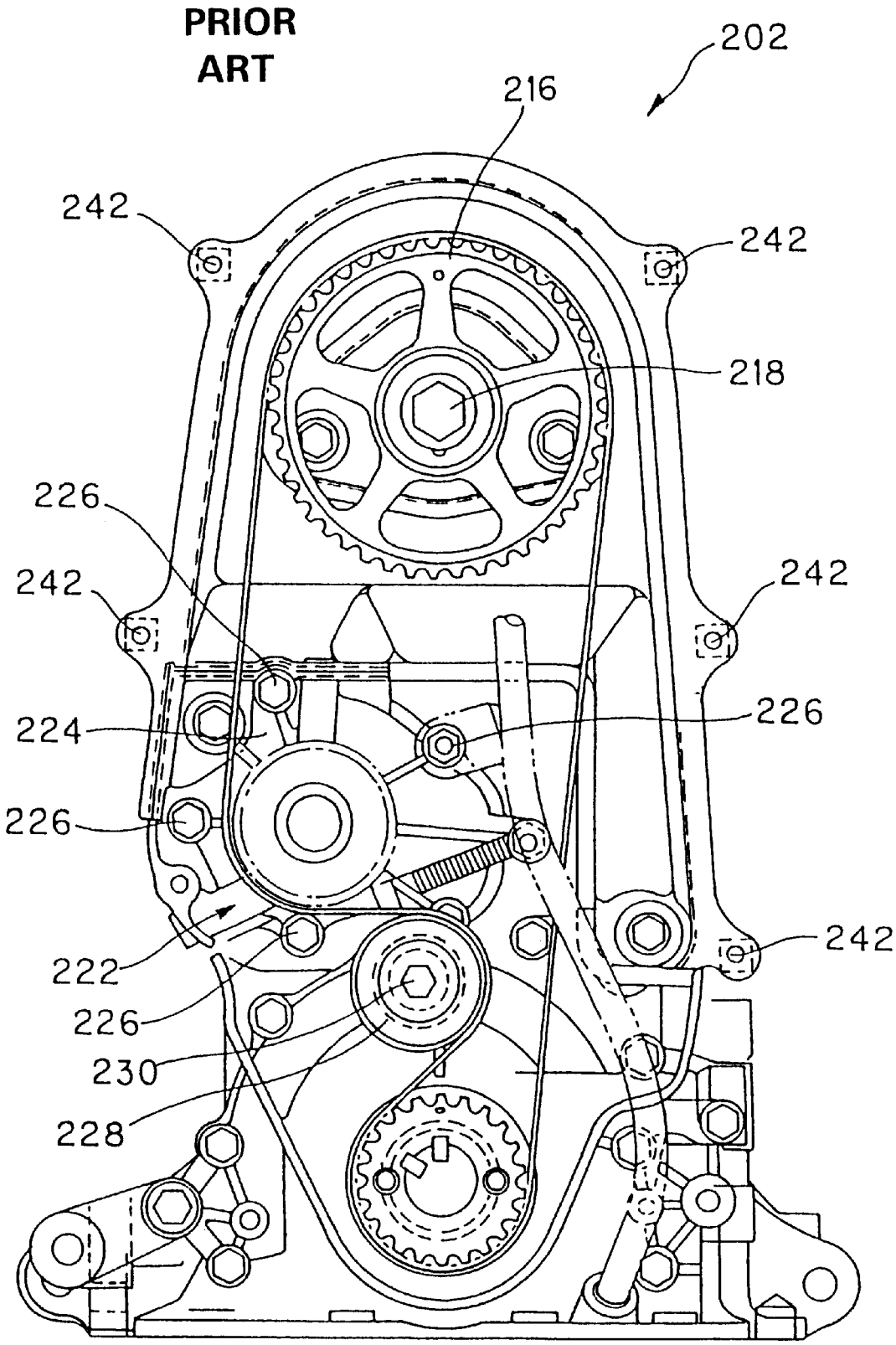
FIG. 22 is a front-view drawing of a conventional engine with the timing belt cover removed.

Referring to FIGS. 5 and 19, a fifth embodiment SG2 of the present invention is described. The characteristics of fifth embodiment SG2 are as follows. A tapered guide 142 is removably disposed on mount attachment boss 74 to fit with timing belt cover 98 when timing belt cover 98 is attached. Guide 142 includes a tapered guide section 144 and a compound section 148 mounted on mount attachment boss 74. Guide 142 has a slit 146.

According to the fifth embodiment, when timing belt cover 98 is attached, compound section 148 of guide body 142 mounts to mount attachment boss 74. Then, bracket opening 104 of timing belt cover 98 fits to guide section 144. This allows timing belt cover 98 to easily fit to mount attachment boss 74. Once timing belt cover 98 is attached to mount attachment boss 74, guide body 142 is pulled off of mount attachment boss 74. This allows timing belt cover 98 to be easily attached.

With the present invention, it is also possible to accurately align water pump 32 and engine mount bracket 70 in other ways such as the following. Water pump 32 and engine mount bracket 70 can be formed integrally. Water pump 32 and engine mount bracket 70 can be positioned with a knock pin. Water pump 32 and engine mount bracket 70 and oil pump 12 can be also formed integrally.

As the detailed description of the present invention presented above shows, an engine mount bracket is fixed to a cylinder block, and a section of the engine mount bracket and a section of an engine accessory are passed through a timing belt cover from the inside to the outside. Thus, a section of the engine accessory and a section of the engine mount bracket serve to position the timing belt cover, allowing easy alignment of the timing belt cover. This allows assembly to take place more efficiently, eliminates the need for separate elements to perform alignment, provides a simplified structure, and reduces costs.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. A structure for an engine comprising:

an engine mount bracket attached to said engine;

an engine accessory attached to said engine;

a timing belt cover attached to said engine;

said timing belt cover having at least an accessory insertion opening and a bracket insertion opening; and a section of said engine mount bracket passing through said bracket insertion opening and a section of said engine accessory passing through said accessory insertion opening, thereby accurately aligning said timing belt cover on said engine.

2. A structure for an engine according to claim 1, further comprising:

an accessory sealing member between said section of said engine accessory and said timing belt cover; and a bracket sealing member between said section of said engine mount bracket and said timing belt cover.

3. A structure for an engine according to claim 1, wherein said engine accessory is attached to said engine using a stud bolt inserted into a bolt insertion opening having a diameter smaller than a diameter of other bolt insertion openings of said engine, thereby accurately aligning said engine accessory on said engine.

4. A structure for an engine according to claim 1, wherein said engine mount bracket has a bracket bolt insertion opening offset from a center of a bracket clamping bolt and an alignment opening offset from a center of a stud bolt, thereby accurately aligning said engine mount bracket on said engine.

5. A structure for an engine according to claim 1, further comprising:

a stud bold attaching an engine component to said engine; and said engine mount bracket is aligned with an end section of said stud bolt.

6. A structure for an engine according to claim 5, further comprising:

a nut engaged with said end section of said stud bolt; and said engine mount bracket supporting said nut, thereby preventing said nut from falling into said engine.

7. A structure for an engine according to claim 1, further comprising:

first processed surfaces on said engine mount bracket;

second processed surfaces on said engine accessory;

said first processed surfaces mating with said second processed surfaces when said engine mount bracket and said engine accessory are attached to said engine, thereby accurately aligning said engine mount bracket and said engine accessory relative to each other.

8. A structure for an engine according to claim 1, wherein:

said engine mount bracket extends a first prescribed distance from said engine;

said engine accessory extends a second prescribed distance from said engine; and said first prescribed distance is offset from said second prescribed distance.

9. A structure for an engine according to claim 1, further comprising:

a removable tapered guide attached to said engine mount bracket; and said removable tapered guide having a tapered guide section tapered away from said engine.

10. An engine structure comprising:

an engine accessory attached to a cylinder block of an engine;

a crank timing pulley on a crank shaft of said engine;

a cam shaft on a cylinder head of said engine;

a timing pulley on said cam shaft;

a timing belt extending between said crank timing pulley and said cam timing pulley;

a timing belt cover fixed to said engine;

an engine mount bracket on said cylinder block; and a section of said engine mount bracket and a section of said engine accessory passing through said timing belt cover, thereby accurately aligning said timing belt cover with said engine.

11. An engine structure according to claim 10, further comprising:

an accessory sealing member between said section of said engine accessory and said timing belt cover; and a bracket sealing member between said section of said engine mount bracket and said timing belt cover.

12. An engine structure according to claim 10, wherein said engine accessory is attached to said engine using a stud bolt inserted into a bolt insertion opening having a diameter smaller than a diameter of other bolt insertion openings of said engine, thereby accurately aligning said engine accessory on said engine.

13. An engine structure according to claim 10, wherein said engine mount bracket has a bracket bolt insertion opening offset from a center of a bracket clamping bolt and an alignment opening offset from a center of a stud bolt, thereby accurately aligning said engine mount bracket on said engine.

14. An engine structure according to claim 10, further comprising:

a stud bold attaching an engine component to said engine; and said engine mount bracket is aligned with an end section of said stud bolt.

15. An engine structure according to claim 14, further comprising:

a nut engaged with said end section of said stud bolt; and said engine mount bracket supporting said nut, thereby preventing said nut from falling into said engine.

16. An engine structure according to claim 10, further comprising:

first processed surfaces on said engine mount bracket;

second processed surfaces on said engine accessory;

said first processed surfaces mating with said second processed surfaces when said engine mount bracket and said engine accessory are attached to said engine, thereby accurately aligning said engine mount bracket and said engine accessory relative to each other.

17. An engine structure according to claim 10, wherein:

said engine mount bracket extends a first prescribed distance from said engine;

said engine accessory extends a second prescribed distance from said engine; and said first prescribed distance is offset from said second prescribed distance.

18. An engine structure according to claim 10, further comprising:

a removable tapered guide attached to said engine mount bracket; and said removable tapered guide having a tapered guide section tapered away from said engine.

* * * * *